US008094094B2

(12) United States Patent
Kim

(10) Patent No.: US 8,094,094 B2
(45) **Date of Patent: *Jan. 10, 2012**

(54) LIGHT EMITTING DEVICE HAVING A DISCHARGING CIRCUIT AND METHOD OF DRIVING THE SAME

(75) Inventor: Ji Hun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 817 days.

This patent is subject to a terminal disclaimer.

(21) Appl. No.: 11/543,142

(22) Filed: Oct. 5, 2006

(65) Prior Publication Data

US 2007/0252789 A1 Nov. 1, 2007

(30) Foreign Application Priority Data

Apr. 28, 2006 (KR) ..... 10-2006-0038692

(51) Int. Cl.
*G09G 3/36* (2006.01)

(52) U.S. Cl. ..... 345/76; 345/77; 345/78; 345/82; 345/84; 345/204; 257/88; 315/169.3

(58) Field of Classification Search ..... 345/210, 345/211, 98, 204, 212, 213, 87, 89, 90, 91, 345/93, 100, 101, 55, 76, 82, 94; 257/88; 315/169.3

See application file for complete search history.

(56) References Cited

U.S. PATENT DOCUMENTS

| | | | | |
|---|---|---|---|---|
| 5,621,439 | A * | 4/1997 | Okada et al. | 345/211 |
| 6,297,792 | B1 * | 10/2001 | Takahashi | 345/91 |
| 6,549,196 | B1 * | 4/2003 | Taguchi et al. | 345/210 |
| 6,650,310 | B2 | 11/2003 | Yoon | 345/87 |
| 2002/0063668 | A1 * | 5/2002 | Yoon | 345/87 |

(Continued)

FOREIGN PATENT DOCUMENTS

WO WO 01/01384 A1 1/2001

OTHER PUBLICATIONS

Bong-Hyun You et al., "P-14: Polarity-Balanced Driving to Reduce Vth Shift in a-Si for Active-Matrix OLEDs," 2004 SID 04 Digest, pp. 272-275 (May 2004).

*Primary Examiner* — Lun-Yi Lao
*Assistant Examiner* — Olga Merkoulova
(74) *Attorney, Agent, or Firm* — Morgan, Lewis & Bockius LLP

(57) ABSTRACT

The present invention relates to a light emitting device for preventing a cross-talk phenomenon and a pectinated pattern. The light emitting device includes data lines, scan lines, pixels and discharging circuit. The data lines are disposed in a first direction. The scan lines are disposed in a second direction different from the first direction. The pixels are formed in cross areas of the data lines and the scan lines. The discharging circuit discharges respectively a first data line and a second data line of the data lines to a first discharge voltage and a second discharge voltage during a first sub-discharging time of a discharging time, and couple the first data line to the second data line during a second sub-discharging time of the discharging time. Here, the second discharge voltage has different magnitude from the first discharge voltage.

19 Claims, 14 Drawing Sheets

U.S. PATENT DOCUMENTS

2002/0167474 A1 11/2002 Everitt ..... 345/82
2003/0030602 A1* 2/2003 Kasai ..... 345/76
2004/0252087 A1* 12/2004 Yazawa ..... 345/76
2005/0156835 A1* 7/2005 Sato ..... 345/76
2007/0057628 A1* 3/2007 Kim ..... 313/504
2007/0095639 A1* 5/2007 Kim et al. ..... 200/310
2007/0120777 A1* 5/2007 Kim ..... 345/76
2007/0139318 A1* 6/2007 Kim ..... 345/82
2007/0252160 A1* 11/2007 Kim ..... 257/88

* cited by examiner

LIGHT EMITTING DEVICE HAVING A DISCHARGING CIRCUIT AND METHOD OF DRIVING THE SAME

CROSS-REFERENCE TO RELATED APPLICATIONS

This application claims priority from Korean Patent Application No. 2006-38692, filed on Apr. 28, 2006, the contents of which are incorporated herein by reference in its entirety.

BACKGROUND OF THE INVENTION

1. Field of the Invention

The present invention relates to a light emitting device and a method of driving the same. More particularly, the present invention relates to a light emitting device for preventing a cross-talk phenomenon and a pectinated pattern and a method of driving the same.

2. Description of the Related Art

A light emitting device emits a light having a certain wavelength when certain voltage or current is provided thereto, and especially an organic electroluminescent device is self light emitting device.

FIG. 1 is a block diagram illustrating a common light emitting device.

In FIG. 1, the light emitting device includes a panel 100, a controller 102, a first scan driving circuit 104, a second scan driving circuit 106, a discharging circuit 108, a precharging circuit 110 and a data driving circuit 112. For example, the light emitting device is organic electroluminescent device.

The panel 100 includes a plurality of pixels E11 to E64 formed in cross areas of data lines D1 to D6 and scan lines S1 to S4.

The controller 102 receives display data from an outside apparatus (not shown), and controls the scan driving circuits 104 and 106, the discharging circuit 108, the precharging circuit 110 and the data driving circuit 112 by using the received display data.

The first scan driving circuit 104 transmits first scan signals to some of the scan lines S1 to S4, e.g. S1 and S3. The second scan driving circuit 106 transmits second scan signals to other scan lines S2 and S4. As a result, the scan lines S1 to S4 are connected in sequence to a ground.

The discharging circuit 108 is connected to the data lines D1 to D6 through switches SW1 to SW6. In addition, the discharging circuit 108 turns on the switches SW1 to SW6 when discharging, and so the data lines D1 to D6 are connected to a zener diode ZD. As a result, the data lines D1 to D6 is discharged up to a zener voltage of the zener diode ZD.

The precharging circuit 110 provides precharge current corresponding to the display data to the discharged data lines D1 to D6 in accordance with control of the controller 102.

The data driving circuit 112 provides data currents corresponding to the display data to the precharged data lines D1 to D6 under control of the controller 102. As a result, the pixels E11 to E64 emit light.

FIG. 2A and FIG. 2B are views illustrating schematically a light emitting device of FIG. 1. FIG. 2C and FIG. 2D are timing diagrams illustrating a process of driving the light emitting device.

Hereinafter, the process of driving the light emitting device will be described after describing cathode voltages VC11 to VC61 corresponding to a first scan line S1.

As shown in FIG. 2A, a resistor between a pixel E11 and the ground is Rs, and a resistor between a pixel E21 and the ground is Rs+Rp. In addition, a resistor between a pixel E31 and the ground is Rs+2Rp, and a resistor between a pixel E41 and the ground is Rs+3Rp. Further, a resistor between a pixel E51 and the ground is Rs+4Rp, and a resistor between a pixel E61 and the ground is Rs+5Rp.

Here, it is assumed that the data currents I11 to I61 having the same magnitude are provided to the data lines D1 to D6 so that the pixels E11 to E61 emit light having the same brightness.

In this case, the data currents I11 to I61 pass to a ground through corresponding pixels E11 to E61 and the first scan line S1. Accordingly, since the data currents I11 to I61 have the same magnitude, cathode voltages VC11 to VC61 of the pixels E11 to E61 are proportioned to resistors between corresponding pixel and the ground. Hence, the values are high in the order of the cathode voltages VC61, VC51, VC41, VC31, VC21 and VC11.

In FIG. 2B, a resistor between a pixel E12 and the ground is Rs+5Rp, and thus is higher than that between the pixel E11 and the ground. Here, it is assumed that the data current I11 passing through the first data line D1 when the first scan line S1 is connected to the ground is identical to data current I12 passing through the first data line D1 when a second scan line S2 is connected to the ground. In this case, because cathode voltages VC11 and VC12 of the pixels E11 and E12 are proportioned to corresponding resistor, the cathode voltage VC12 is higher than the cathode voltage VC11.

Hereinafter, a process of driving the light emitting device will be described in detail.

The switches SW1 to SW6 are turned on, and the scan lines S1 to S4 are connected to a non-luminescent source having the same magnitude (V2) as a driving voltage of the light emitting device, e.g. voltage corresponding to maximum brightness of data current. Accordingly, the pixels E11 to E64 does not emit light, and the data lines D1 to D6 are discharged to a zener voltage of the zener diode ZD during a first discharge period of time (dcha1).

Subsequently, the switches SW1 to SW6 are turned off.

Then, precharge current corresponding to first display data is provided to the data lines D1 to D6 during a first precharge period of time (pcha1) as shown in FIG. 2C and FIG. 2D.

Subsequently, the first scan line S1 is connected to the ground as shown in FIG. 2A, and the other scan lines S2 to S4 are connected to the non-luminescent source.

Then, the data currents I11 to I61 corresponding to the first display data are provided to the data lines D1 to D6 during a first luminescent period of time (t1) as shown in FIG. 2C and FIG. 2D. As a result, the pixels E11 to E61 emit light during the first luminescent period of time (t1).

Hereinafter, the pixel E61 is assumed to have the same brightness as the pixel E11. That is, the data currents I11 and I61 having the same magnitude are provided to the data lines D1 and D6 during the first luminescent period of time (t1).

First, the data lines D1 and D6 are discharged up to the same discharge voltage during the first discharge period of time (dcha1) when discharging as shown in FIG. 2D, and so the data lines D1 and D6 are precharged to the same precharge level, i.e. certain precharge voltage during a first precharge period of time (pcha1).

Subsequently, the data currents I11 and I61 having the same magnitude are provided to the data lines D1 and D6, respectively. In this case, since the pixels E11 and E61 are preset to emit light having the same brightness, anode voltages VA11 and VA61 of the pixels E11 and E61 rise from the precharge voltage to a voltage which is different from corresponding cathode voltages VC11 and VC61 by a certain level, and then the voltages VA11 and VA61 are saturated. This is because a pixel emits a light having brightness corresponding to difference of its anode voltage and its cathode voltage.

For example, in case that the cathode voltage VC11 of the pixel E11 and the cathode voltage VC61 of the pixel E61 are 1V and 2V, respectively, the anode voltage V61 of the pixel E61 is saturated with 7V when the anode voltage VA11 of the pixel E11 is saturated with 6V. In this case, because the data lines D1 and D6 are precharged up to the same precharge voltage, e.g. 3V, the anode voltage VA11 of the pixel E11 is saturated with 6V after rising from 3V up to 6V Whereas, the anode voltage VA61 of the pixel E61 is saturated with 7V after rising 3V up to 7V. Hence, charge amount consumed until the anode voltage VA61 of the pixel E61 is saturated is higher than that consumed until the anode voltage VA11 of the pixel E11 is saturated. Accordingly, though the pixels E11 and E61 are preset to have the same brightness, the pixel E61 emits a light having brightness smaller than the pixel E11.

Hereinafter, the process of driving the light emitting device will be described continuously.

The scan lines S1 to S4 are connected to the non-luminescent source, and the switches SW1 to SW6 are turned on. As a result, the data lines D1 to D6 is discharged up to a certain discharge voltage during a second discharge period of time (dcha2) as shown in FIG. 2C.

Subsequently, the switches SW1 to SW6 are turned off, and then precharge current corresponding to second display data is provided to the data lines D1 to D6. Here, the second display data is inputted to the controller 102 after the first display data is provided to the controller 102.

Then, the second scan line S2 is connected to the ground, and the other scan lines S1, S3 and S4 are connected to the non-luminescent source.

Subsequently, data currents I12 to I62 corresponding to the second display data are provided to the data lines D1 to D6, and so pixels E12 to E62 emit light during the second luminescent period of time (t2).

Hereinafter, the pixel E12 is preset to have the same brightness as the pixel E11.

In this case, because the resistor between the pixel E12 and the ground is higher than the resistor between the pixel E11 and the ground, the cathode voltage VC12 of the pixel E12 is higher than the cathode voltage VC11 of the pixel E11. Hence, charge amount consumed until the anode voltage VA12 of the pixel E12 is saturated is higher than that consumed until the anode voltage VA11 of the pixel E11 is saturated. Accordingly, the pixel E12 emits a light having brightness smaller than the pixel E11. This phenomenon that pixels preset to have the same brightness emit really light having different brightness is referred to as "cross-talk phenomenon".

Hereinafter, the brightness of the pixels E11 to E61 corresponding to the first scan line S1 and the pixels E12 to E62 corresponding to the second scan line S2 will be compared.

As described above, the pixel E11 of the pixels E11 to E61 corresponding to the first scan line S1 emits a light having highest brightness of the pixels E11 to E61, and the pixel E61 emits a light having smallest brightness of the pixels E11 to E61. In addition, the pixel E12 of the pixels E12 to E62 corresponding to the second scan line S2 emits a light having smallest brightness of the pixels E12 to E62, and the pixel E62 emits a light having highest brightness of the pixels E12 to E62. Hence, brightness difference between the pixels E11 and E12 related to the first data line D1 and brightness difference between the pixels E61 and E62 related to the sixth data line D2 are higher than brightness difference between the pixels E21 to E52 related to the other data lines D2 to D5. As a result, line patterns are generated at a part between the pixels E11 and E12 and a part between the pixels E61 and E62 of the panel 100. This is referred to as "pectinated pattern".

SUMMARY OF THE INVENTION

It is a feature of the present invention to provide a light emitting device where cross-talk phenomenon and a pectinated pattern are not occurred and a method of driving the same.

A light emitting device according to one embodiment of the present invention includes data lines, scan lines, pixels and discharging circuit. The data lines are disposed in a first direction. The scan lines are disposed in a second direction different from the first direction. The pixels are formed in cross areas of the data lines and the scan lines. The discharging circuit discharges respectively a first data line and a second data line of the data lines to a first discharge voltage and a second discharge voltage during a first sub-discharging time of a discharging time, and couple the first data line to the second data line during a second sub-discharging time of the discharging time. Here, the second discharge voltage has different magnitude from the first discharge voltage.

An electroluminescent device according to one embodiment of the present invention includes data lines, scan lines, pixels and discharging circuit. The data lines are disposed in a first direction. The scan lines are disposed in a second direction different from the first direction. The pixels are formed in cross areas of the data lines and the scan lines. The discharging circuit discharges some of the data lines to a first discharge voltage and the other data lines to a second discharge voltage during a first sub-discharging time of a discharging time, and couple the data lines during a second sub-discharging time of the discharging time. Here, the second discharge voltage is different from the first discharge voltage, and the data lines are discharged to discharge voltages corresponding to cathode voltages of pixels related to the data lines according as the data lines are coupled.

A method of driving a light emitting device having a plurality of pixels formed in cross areas of data lines and scan lines includes discharging a first data line of the data lines to a first discharge voltage, and second data line of the data lines to a second discharge voltage during a first sub-discharging time of a discharge time; and coupling the first data line to the second data line during a second sub-discharging time of the discharging time. Here, the second discharge voltage is different from the first discharge voltage.

As described above, the light emitting device and a method of driving the same of the present invention discharge the data lines up to discharge voltages corresponding to cathode voltages of pixels related to the data lines, cross-talk phenomenon and pectinated pattern are not occurred in the light emitting device.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF EMBODIMENTS

Hereinafter, the preferred embodiments of the present invention will be explained in more detail with reference to the accompanying drawings.

Figure 1:
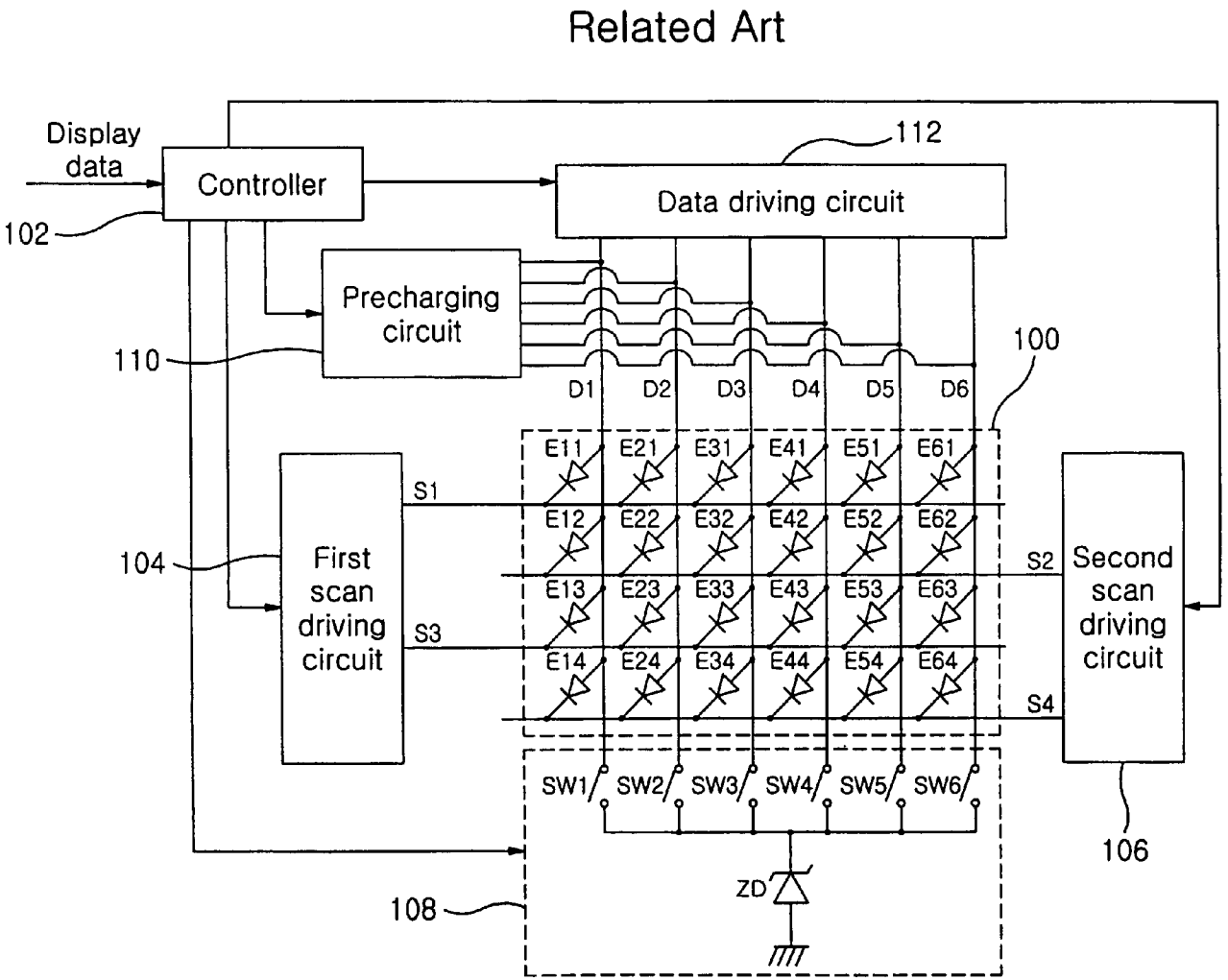
FIG. 1 is a block diagram illustrating a common light emitting device.
Figure 2A:
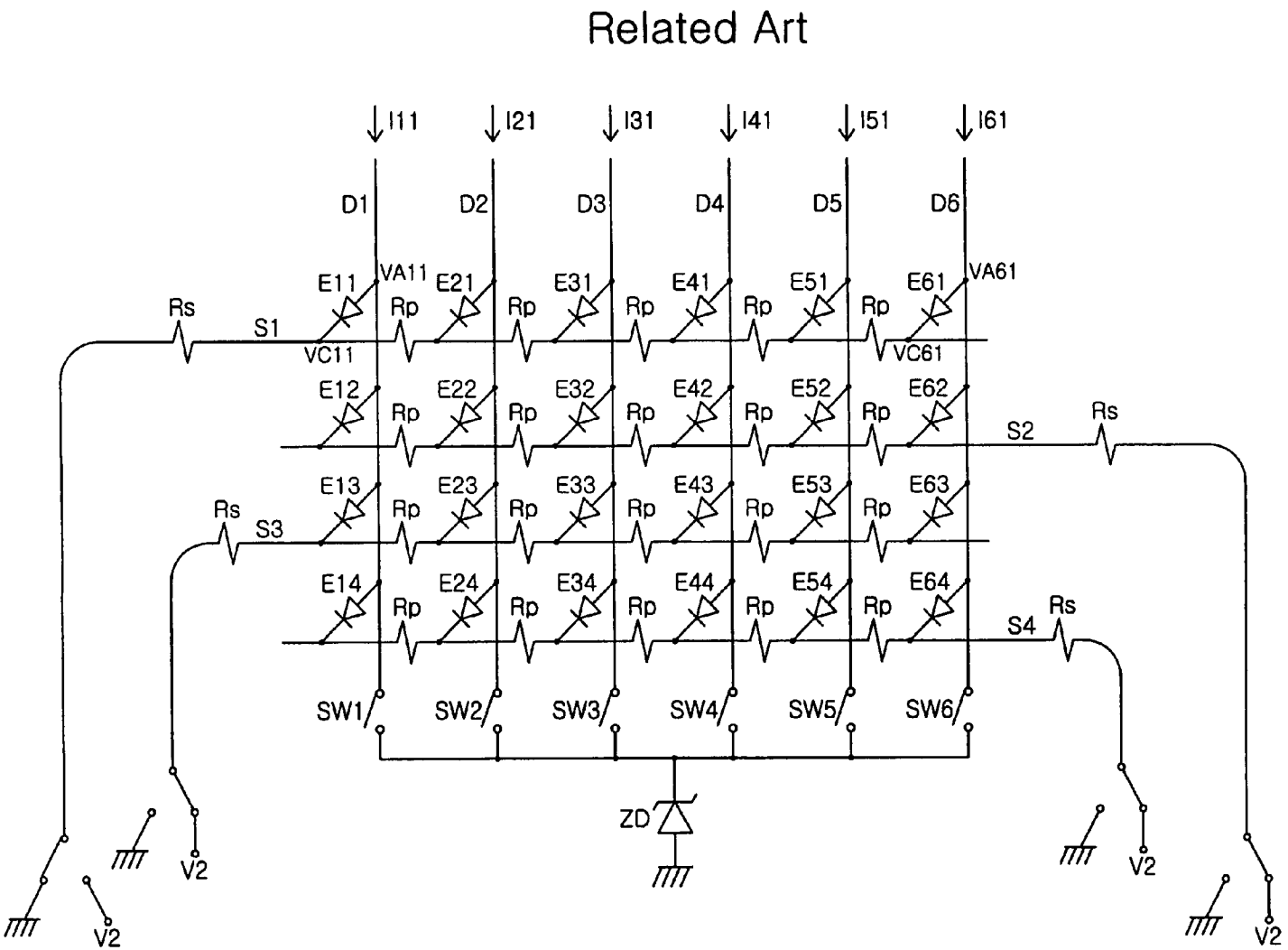
FIG. 2A and FIG. 2B are views illustrating schematically a light emitting device of FIG. 1.
Figure 2B:
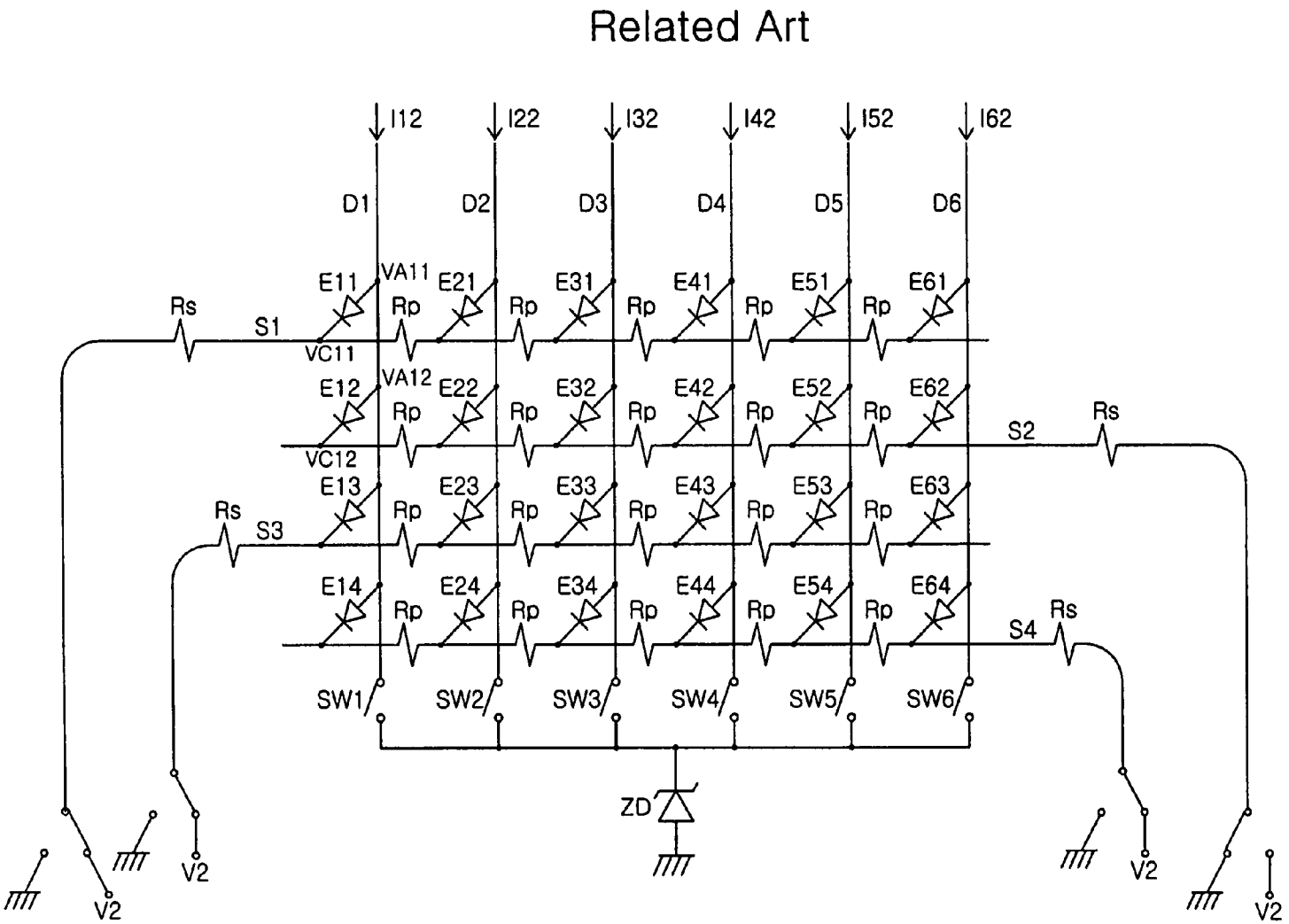
Figure 2C:
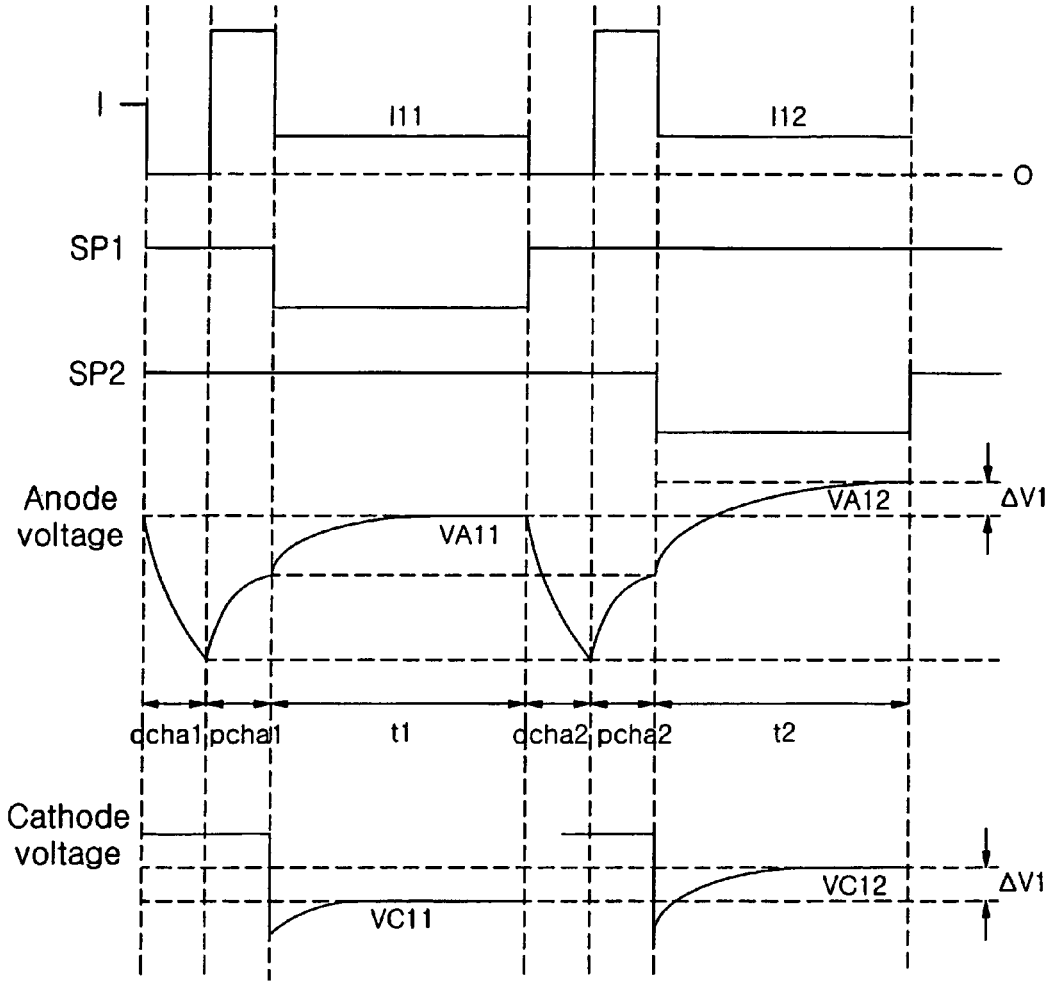
FIG. 2C Related Art
FIG. 2C and FIG. 2D are timing diagrams illustrating a process of driving the light emitting device.
Figure 2D:
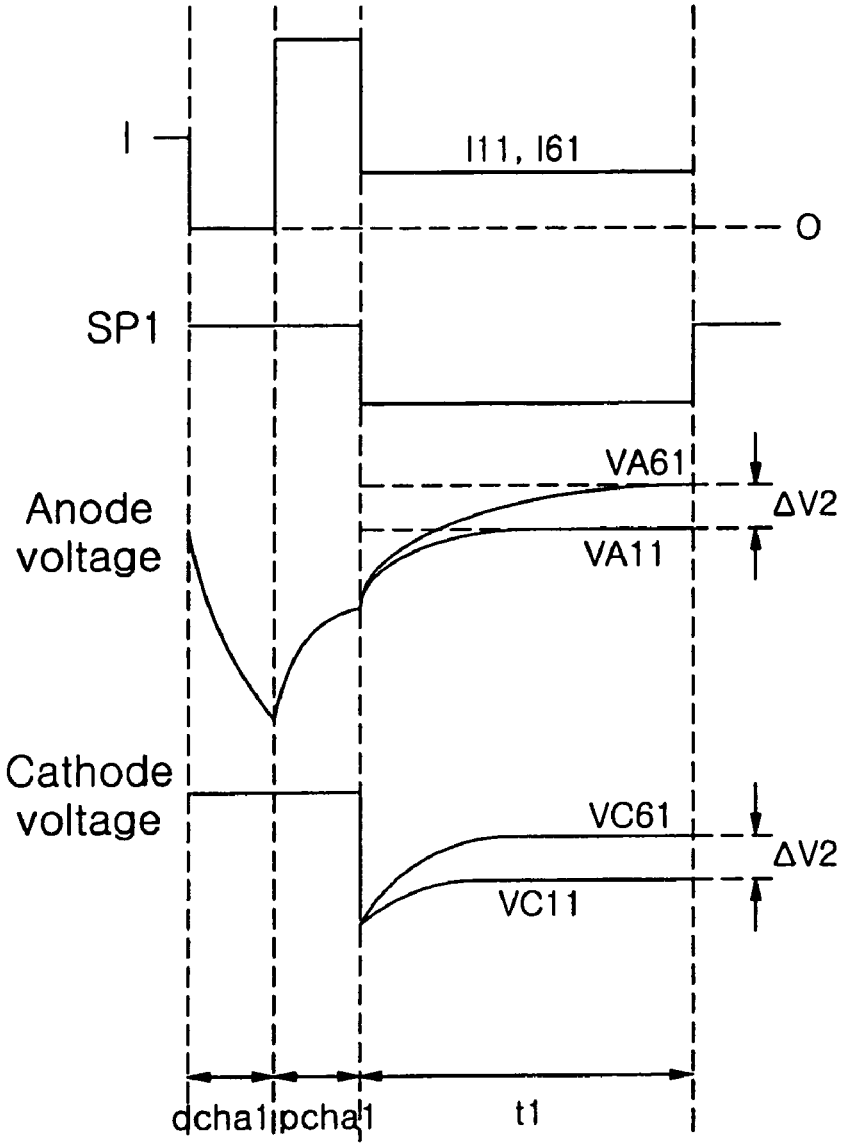
FIG. 2D Related Art
Figure 3A:
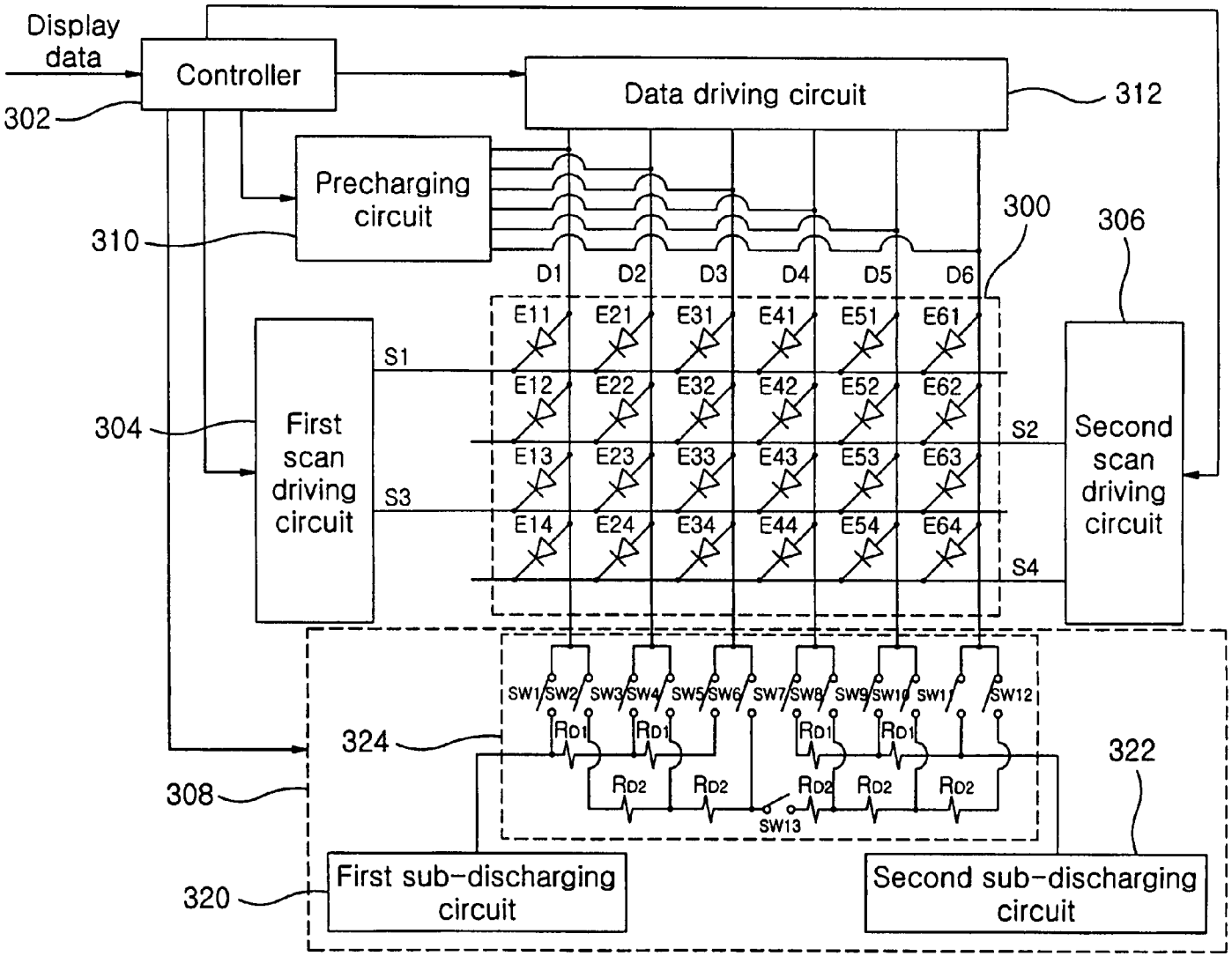
FIG. 3A is a view illustrating a light emitting device according to a first embodiment of the present invention.
Figure 3B:
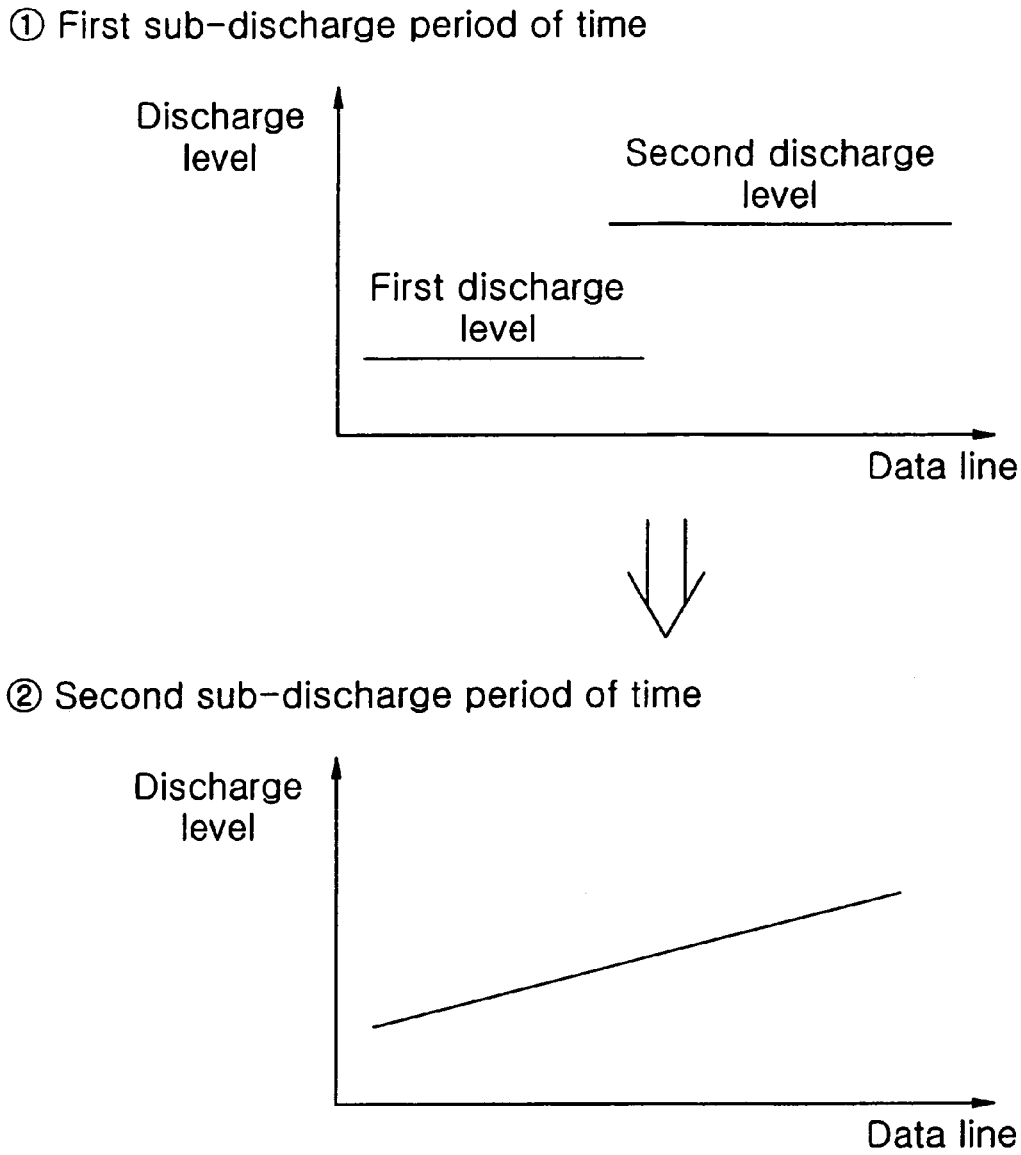
FIG. 3B is a view illustrating a discharge level graph in accordance with operation of a discharging circuit in FIG. 3A.

FIG. 3A is a view illustrating a light emitting device according to a first embodiment of the present invention. FIG. 3B is a view illustrating a discharge level graph in accordance with operation of a discharging circuit in FIG. 3A.

In FIG. 3A, the light emitting device of the present invention includes a panel 300, a controller 302, a first scan driving circuit 304, a second scan driving circuit 306, a discharging circuit 308, a precharging circuit 310 and a data driving circuit 312.

The light emitting device according to one embodiment of the present invention includes an organic electroluminescent device, a plasma display panel, a liquid crystal display, and others. Hereinafter, the organic electroluminescent device will be described as an example of the light emitting device for convenience of the description.

The panel 300 has a plurality of pixels E11 to E64 formed in cross areas of data lines D1 to D6 and scan lines S1 to S4.

At least one of the pixels E11 to E64 includes an anode electrode layer, an organic layer and a cathode electrode layer formed in sequence on a substrate.

The controller 302 receives display data, e.g. RGB data from an outside apparatus (not shown), and controls the scan driving circuits 304 and 306, the discharging circuit 308, the precharging circuit 310 and the data driving circuit 312. In addition, the controller 302 may store the received display data in a memory included therein.

The first scan driving circuit 304 transmits first scan signals to some of the scan lines S1 to S4, e.g. S1 and S3. The second scan driving circuit 306 transmits second scan signals to the other scan lines S2 and S4. As a result, the scan lines S1 to S4 are coupled to a luminescent source, e.g. ground.

The discharging circuit 308 discharges the data lines D1 to D6 up to discharge voltages corresponding to cathode voltages of pixels related to the data lines D1 to D6, and includes a first sub-discharging circuit 320, a second sub-discharging circuit 322 and a discharge level circuit 324.

The discharge level circuit 324 has a plurality of switches SW1 to SW13.

The first sub-discharging circuit 320 provides a first voltage to some of the data lines D1 to D6, e.g. D1 to D3 during a first sub-discharge period of time of a discharge period of time, thereby discharging the data lines D1 to D3 up to a first discharge level as shown in FIG. 3B. Here, the switches SW1, SW3, SW5, SW7, SW9 and SW11 are turned on, and the other switches SW2, SW4, SW6, SW8, SW10, SW12 and SW13 are turned off Additionally, the data lines D1 to D3 are coupled one another as shown in FIG. 3A, and each of resistors $R_{D1}$ between the data lines D1 to D3 has a first resistance.

The second sub-discharging circuit 322 provides a second voltage to the other data lines D4 to D6 during the first sub-discharge period of time, thereby discharging the data lines D4 to D6 up to a second discharge level as shown in FIG. 3B. Here, the data lines D4 to D6 are coupled one another as shown in FIG. 3A, and each of resistors $R_{D1}$ between the data lines D4 to D6 has the first resistance.

Subsequently, the switches SW1, SW3, SW5, SW9 and SW11 are turned off, and the other switches SW2, SW4, SW6, SW8, SW10, SW12 and SW13 are turned on. As a result, the data lines D1 to D6 are coupled one another, and so the data lines D1 to D6 are discharged up to discharge voltages having constant slope (straight line or curve) as shown in FIG. 3B. In other words, the data lines D1 to D6 are discharged up to discharge voltages corresponding to cathode voltages of pixels related to the data lines D1 to D6 described below. Here, the data lines D1 to D6 are coupled one another as shown in FIG. 3A, and each of resistors $R_{D2}$ between the data lines D1 to D6 has a second resistance. In this case, the sub-discharging circuits 320 and 322 never output current.

As described above, the second discharge level is higher than the first discharge level as shown in FIG. 3B. However, the first discharge level may be higher than the second discharge level in accordance with disposition direction of scan line. This will be described in detail with reference to the accompanying drawings.

In the light emitting device of the present invention, the resistors $R_{D1}$ have the same first resistances, and the resistors $R_{D2}$ have the same second resistances. Here, the second resistance is higher than the first resistance.

In another embodiment of the present invention, the resistors $R_{D1}$ have the same first resistances, and the resistors $R_{D2}$ have the second resistances. Here, at least one of the second resistances has different magnitude from the other second resistances, and the second resistance is higher than the first resistance.

The precharging circuit 310 provides precharge current corresponding to the display data to the discharged data lines D1 to D6 under control of the controller 302.

The data driving circuit 312 provides data signals, i.e. data currents corresponding to the display data and synchronized with the scan signals to the precharged data lines D1 to D6. As a result, the pixels E11 to E64 emit light.

Hereinafter, a process of driving the light emitting device of the present invention will be described in detail.

The first scan line S1 is coupled to a luminescent source, e.g. ground, and the other scan lines S2 to S4 are coupled to a non-luminescent source having the same magnitude (V2) as a driving voltage of the light emitting device, e.g. voltage corresponding to maximum brightness of data current.

Then, first data currents corresponding to first display data are provided to the data lines D1 to D6. In this case, the first data currents are passed to the ground through the pixels E11 to E61 related to the data lines D1 to D6 and the first scan line S1. As a result, the pixels E11 to E61 corresponding to the first scan line S1 emit light.

Subsequently, the data lines D1 to D6 are discharged up to discharge voltages corresponding to cathode voltages of the pixels E12 to E62 during a first discharge period of time.

Then, the data lines D1 to D6 are precharged up to precharge voltages corresponding to second display data inputted to the controller 302 after the first display data is inputted to the controller 302.

Subsequently, the second scan line S2 is coupled to the ground, and the other scan lines S1, S3 and S4 are coupled to the non-luminescent source.

Then, second data currents corresponding to the second display data are provided to the data lines D1 to D6, and so pixels E12 to E62 related to the second scan line S2 emit light.

Pixels E13 to E63 corresponding to a third scan line S3 emit light, and then pixels E14 to E64 corresponding to a fourth scan line S4 emit light through the method described above. Then, the above process of emitting light in the pixels E11 to E64 is repeated in units of the scan lines S1 to S4, i.e. frame.

Figure 4A:
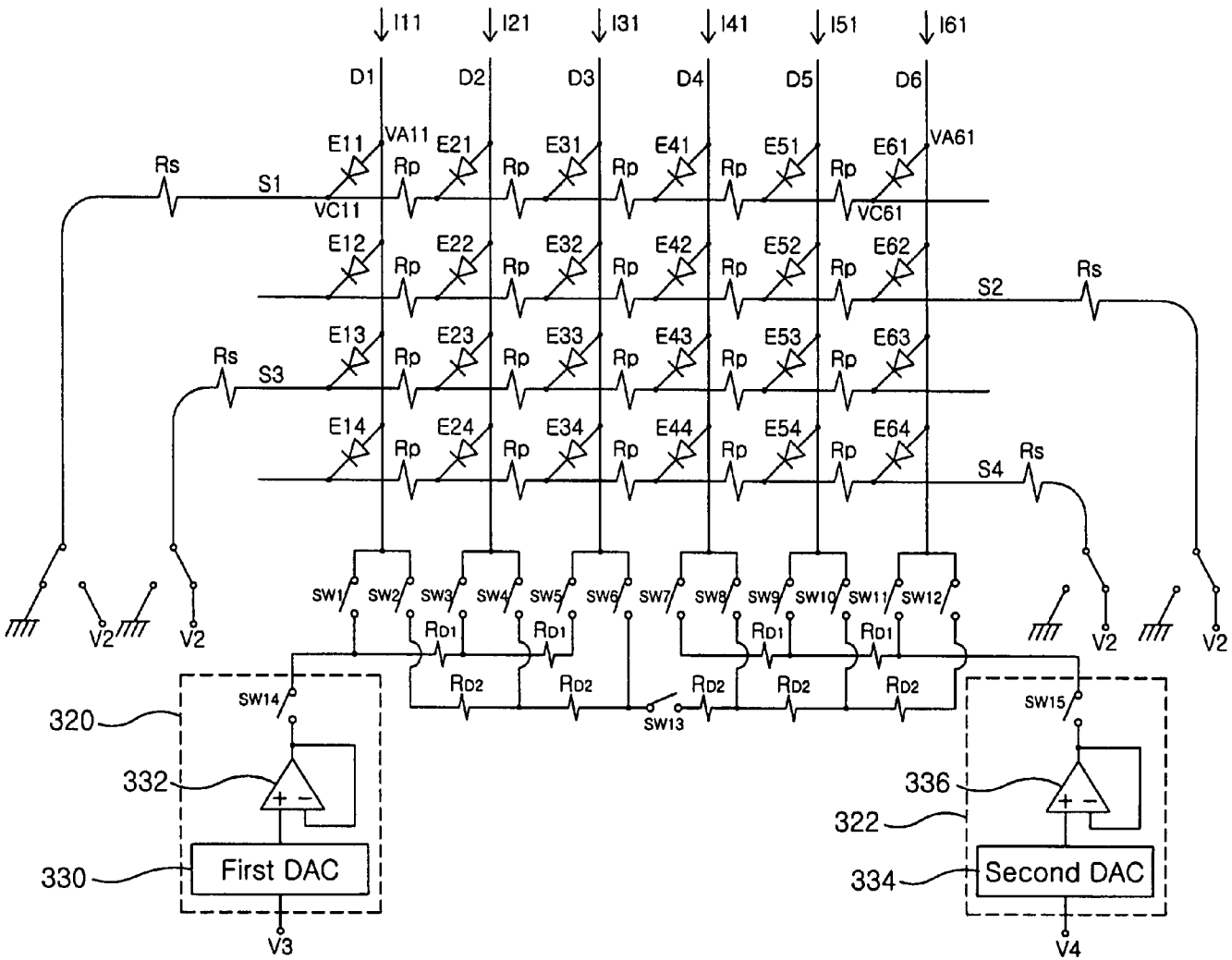
FIG. 4A and FIG. 4B are views illustrating schematically circuitries of the light emitting device in FIG. 3A.
Figure 4B:
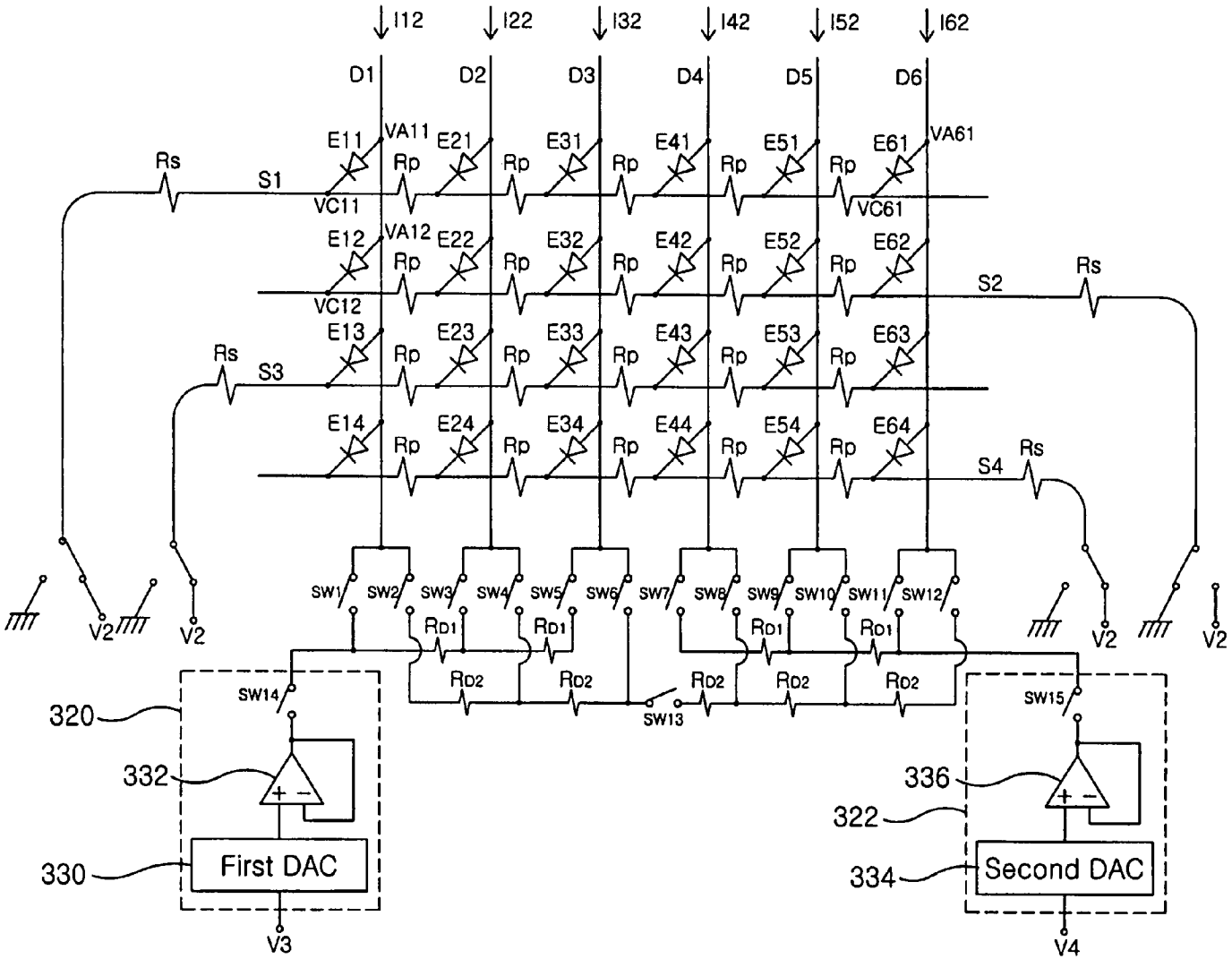
Figure 4C:
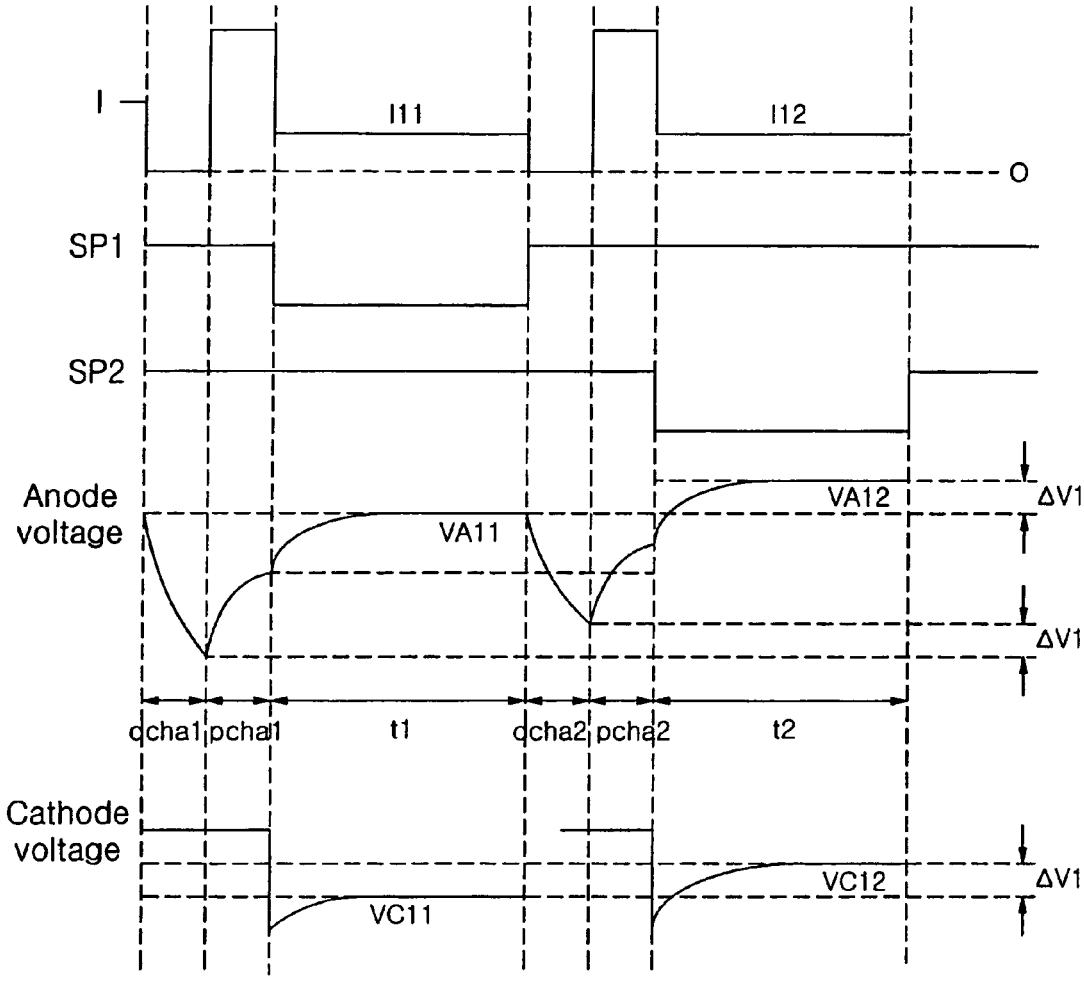
FIG. 4C and FIG. 4D are timing diagrams illustrating a process of driving the light emitting device.
Figure 4D:
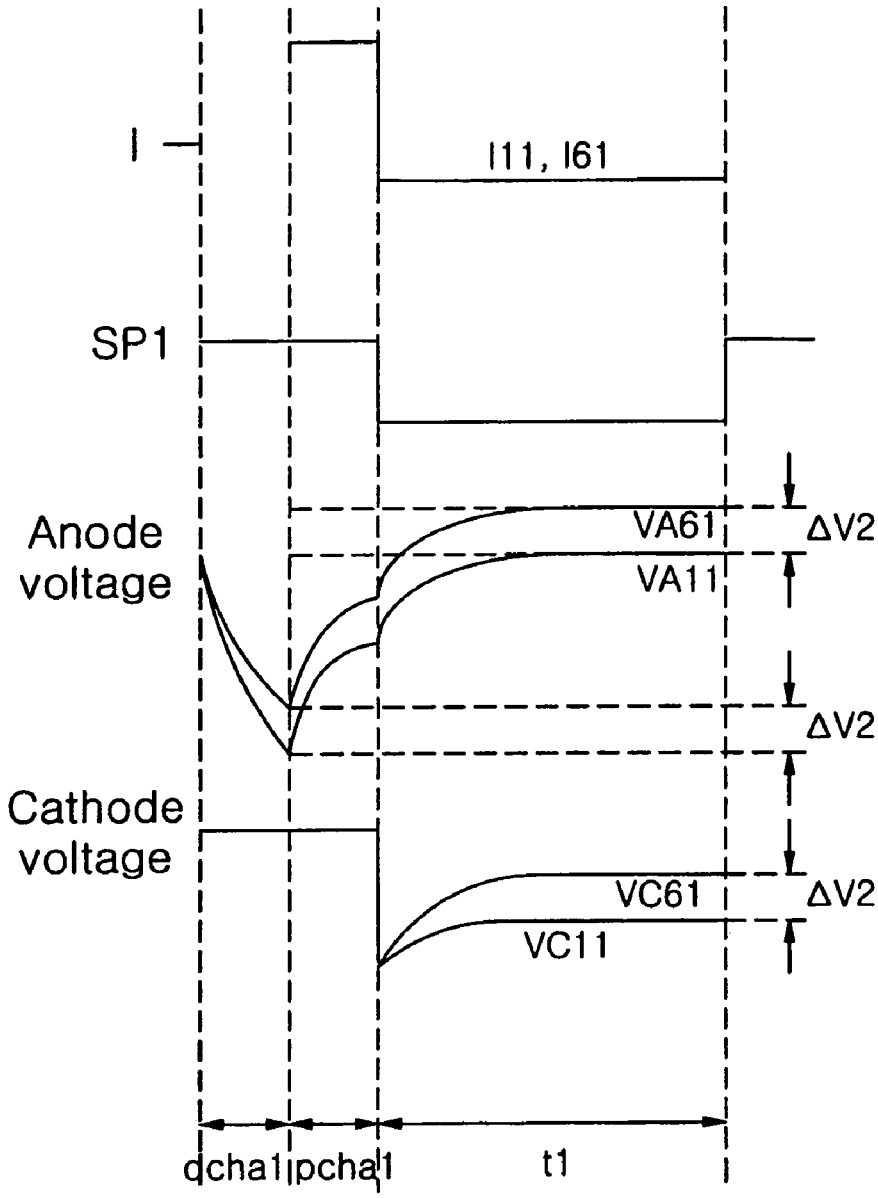

FIG. 4A and FIG. 4B are views illustrating schematically circuitries of the light emitting device in FIG. 3A. FIG. 4C and FIG. 4D are timing diagrams illustrating a process of driving the light emitting device.

In FIG. 4A, the first sub-discharging circuit 320 includes a switch SW14, a first digital-analog converter (first DAC) 330 and a first OP amplifier 332.

The second sub-discharging circuit 322 includes a switch SW15, a second DAC 334 and a second OP amplifier 336.

Hereinafter, a process of driving the light emitting device will be described after cathode voltages VC11 to VC61 of the pixels E11 to E61 related to the first scan line S1 are compared.

As shown in FIG. 4A, a resistor between the pixel E11 and the ground is Rs, and a resistor between the pixel E21 and the ground is Rs+Rp. In addition, a resistor between a pixel E31 and the ground is Rs+2Rp, and a resistor between a pixel E41 and the ground is Rs+3Rp. Further, a resistor between a pixel E51 and the ground is Rs+4Rp, and a resistor between a pixel E61 and the ground is Rs+5Rp.

Here, it is assumed that data currents I11 to I61 having the same magnitude are provided to the data lines D1 to D6 so that the pixels E11 to E61 have the same brightness.

In this case, the data currents I11 to I61 are passed to the ground through corresponding pixel and the first scan line S1. Accordingly, since the data currents I11 to I61 have the same magnitude, each of the cathode voltages VC11 to VC61 of the pixels E11 to E61 are proportioned to resistor between the corresponding pixel and the ground. Hence, the values are high in the order of VC61, VC51, VC41, VC31, VC21 and VC11.

In FIG. 4B, a resistor between a pixel E12 and the ground is Rs+5Rp, and is higher than the resistor between the pixel E11 and the ground. Here, it is assumed that the data current I11 passing through the first data line D1 when the first scan line S1 is coupled to the ground is identical to data current I12 passing through the first data line D1 when a second scan line S2 is coupled to the ground. In this case, because cathode voltages VC11 and VC12 of the pixels E11 and E12 are proportioned to corresponding resistor, the cathode voltage VC12 is higher than the cathode voltage VC11.

Hereinafter, the process of driving the light emitting device will be described in detail.

The discharging circuit 308 discharges the data lines D1 to D6.

Hereinafter, a process of discharging the data lines D1 to D6 will be described in detail.

The switches SW1, SW3, SW5, SW7, SW9, SW11, SW14 and SW15 are turned on during a first sub-discharge period of time of a discharge period of time, and the other switches SW2, SW4, SW6, SW8, SW10, SW12 and SW13 are turned off. Additionally, the scan lines S1 to S4 are coupled to the non-luminescent source having the voltage V2.

Subsequently, the first DAC 330 outputs a first level voltage in accordance with a first outside voltage V3 inputted from an outside apparatus, and the outputted first level voltage is inputted to the first OP amplifier 332. Further, the second DAC 334 outputs a second level voltage in accordance with a second outside voltage V4 inputted from an outside apparatus, and the outputted second level voltage is inputted to the second OP amplifier 336.

Then, the first OP amplifier 332 outputs a certain voltage in accordance with the inputted first level voltage, and thus the data lines D1 to D3 are discharged up to a first discharge level. Moreover, the second OP amplifier 336 outputs a certain voltage in accordance with the inputted second level voltage, and so the data lines D4 to D6 are discharged up to a second discharge level. Here, the second discharge level is different from the first discharge level.

In another embodiment, the OP amplifiers 322 and 336 may output certain currents so that the data lines D1 to D6 have certain voltages.

Subsequently, the switches SW1, SW3, SW5, SW7, SW9, SW11, SW14 and SW15 are turned off during a second sub-discharge period of time of the discharge period of time, and the other switches SW2, SW4, SW6, SW8, SW10, SW12 and SW13 are turned on. As a result, the data lines D1 to D6 are discharged up to discharge voltages having constant slope as shown in FIG. 3B. In this case, to mix adequately charges corresponding to the first discharge level charged to the data lines D1 to D3 with charges corresponding to the second discharge level charged to the data lines D4 to D6, second resistances of resistors $R_{D2}$ corresponding to the second sub-discharge period of time are preset to have value higher than first resistances of resistors $R_{D1}$ corresponding to the first sub-discharge period of time.

In the light emitting device according to another embodiment of the present invention, to make the data lines D1 to D6 have rapidly the discharge voltages shown in FIG. 3B, the more the data lines D1 to D6 are next to the switch SW13, the smaller the second resistances have values.

In brief, the data lines D1 to D6 are discharged up to discharge voltages having sequential magnitudes as shown in FIG. 3B.

In the above case, since the cathode voltage VC61 is higher than the cathode voltage VC11, the second discharge level is preset to have value higher than the first discharge level.

Hereinafter, the pixel E61 is preset to have the same brightness as the pixel E11. That is, data currents I11 and I61 having the same magnitude are provided to the data lines D1 and D6 during a first luminescent period of time t1.

In this case, because the cathode voltage VC61 is higher than the cathode voltage VC11, the data line D6 is discharged up to a discharge voltage higher than a discharge voltage corresponding to the data line D1 during a first discharge period of time as shown in FIG. 4D. Thus, the data line D6 is precharged up to a second precharge voltage higher than a first precharge voltage corresponding to the data line D1.

Subsequently, the first scan line S1 is coupled to the ground, and the other scan lines S2 to S4 are coupled to the non-luminescent source.

Then, the data currents I11 and I61 having the same magnitude and corresponding to first display data are provided to the data lines D1 and D6, respectively. In this case, since the pixels E11 and E61 are preset to emit light having the same brightness, anode voltages VA11 and VA61 of the pixels E11 and E61 rise from the precharge voltage to a voltage which is different from corresponding cathode voltages VC11 and VC61 by a certain level, and then the anode voltages VA11 and VA61 are saturated. This is because a pixel emits a light having brightness corresponding to difference of its anode voltage and its cathode voltage.

For example, in case that the cathode voltage VC11 of the pixel E11 and the cathode voltage VC61 of the pixel E61 are 1V and 2V, respectively, the anode voltage VA61 of the pixel E61 is saturated with 7V when the anode voltage VA11 of the pixel E11 is saturated with 6V. In this case, because the data line D6 is precharged up to the second precharge voltage higher than the first precharge voltage corresponding to the data line D1, the anode voltage VA11 of the pixel E11 rises from the first precharge voltage, e.g. 3V to 6V, and then is saturated with 6V Whereas, the anode voltage VA61 of the pixel E61 rises from the second precharge voltage, e.g. 4V to 7V, and then is saturated with 7V. In other words, the anode voltages VA11 and VA61 of the pixels E11 and E61 rise from corresponding cathode voltages VC11 and VC61 by the same level as shown in FIG. 4D, and then are saturated. Accordingly, charge amount consumed until the anode voltage VA61 of the pixel E61 is saturated is substantially identical to that consumed until the anode voltage VA11 of the pixel E11 is saturated. Hence, in case that the pixels E11 and E61 are preset to emit light having the same brightness, the brightness (VA61-VC61) of the pixel E61 is substantially identical to the brightness (VA11-VC11) of the pixel E11.

Hereinafter, the process of driving the light emitting device will be continuously described.

The switches SW1, SW3, SW5, SW7, SW9, SW11, SW14 and SW15 are turned on, and the other switches SW2, SW4, SW6, SW8, SW10, SW12 and SW13 are turned off. In addition, the scan lines S1 to S4 are coupled to the non-luminescent source.

Subsequently, the first sub-discharging circuit 320 provides a certain voltage to the data lines D1 to D3, thereby discharging the data lines D1 to D3 up to a third discharge level. The second sub-discharging circuit 322 provides a certain voltage to the data lines D4 to D6, thereby discharging the data lines D4 to D6 up to a fourth discharge level.

Then, the switches SW1, SW3, SW5, SW7, SW9, SW11, SW14 and SW15 are turned off, and the other switches SW2, SW4, SW6, SW8, SW10, SW12 and SW13 are turned on. As a result, the data lines D1 to D6 are coupled one another, and so the data lines D1 to D6 are discharged up to discharge voltages having a certain slope. Here, because the cathode voltage VC12 is higher than a cathode voltage VC62, the third discharge level is higher than the fourth discharge level. Accordingly, the discharge voltages of the data lines D1 to D6 are increased in the direction of the pixel E12 from the pixel E62.

Hereinafter, the discharge voltages corresponding to the pixels E11 and E12 will be compared.

Since the cathode voltage VC12 of the pixel E12 is higher than the cathode voltage VC11 of the pixel E11, in the first discharge period of time (dcha1), the data line D1 is discharged up to a discharge voltage higher than in the second discharge period of time (dcha2) as shown in FIG. 4C.

Then, precharge current corresponding to second display data is provided to the data lines D1 to D6. Here, the second display data is inputted to the controller 302 after the first display data is inputted to the controller 302.

Subsequently, the second scan line S2 is coupled to the ground, and the other scan lines S1, S3 and S4 are coupled to the non-luminescent source.

Then, data currents I12 to I62 corresponding to the second display data are provided to the data lines D1 to D6.

In this case, though the cathode voltage VC12 of the pixel E12 is higher than the cathode voltage VC11 of the pixel E11, charge amount consumed until an anode voltage VA12 of the pixel E12 is saturated is substantially identical to that consumed until the anode voltage VA11 of the pixel E11 is saturated because the precharge voltage corresponding to the pixel E12 is higher than the precharge voltage corresponding to the pixel E11. Accordingly, the brightness (VA12-VC12) of the pixel E12 is substantially identical to that (VA11-VC11) of the pixel E11.

In the method of driving the light emitting device, discharge voltage and precharge voltage of data line are adjusted in accordance with cathode voltage of pixel related to the data line unlike a method in Related Art. Accordingly, in case that pixels are preset to have the same brightness, the pixels emit light having the same brightness irrespective of cathode voltages of the pixels.

In short, a cross-talk phenomenon and a pectinated pattern are not occurred on the panel 300 in the light emitting device of the present invention.

Figure 5:
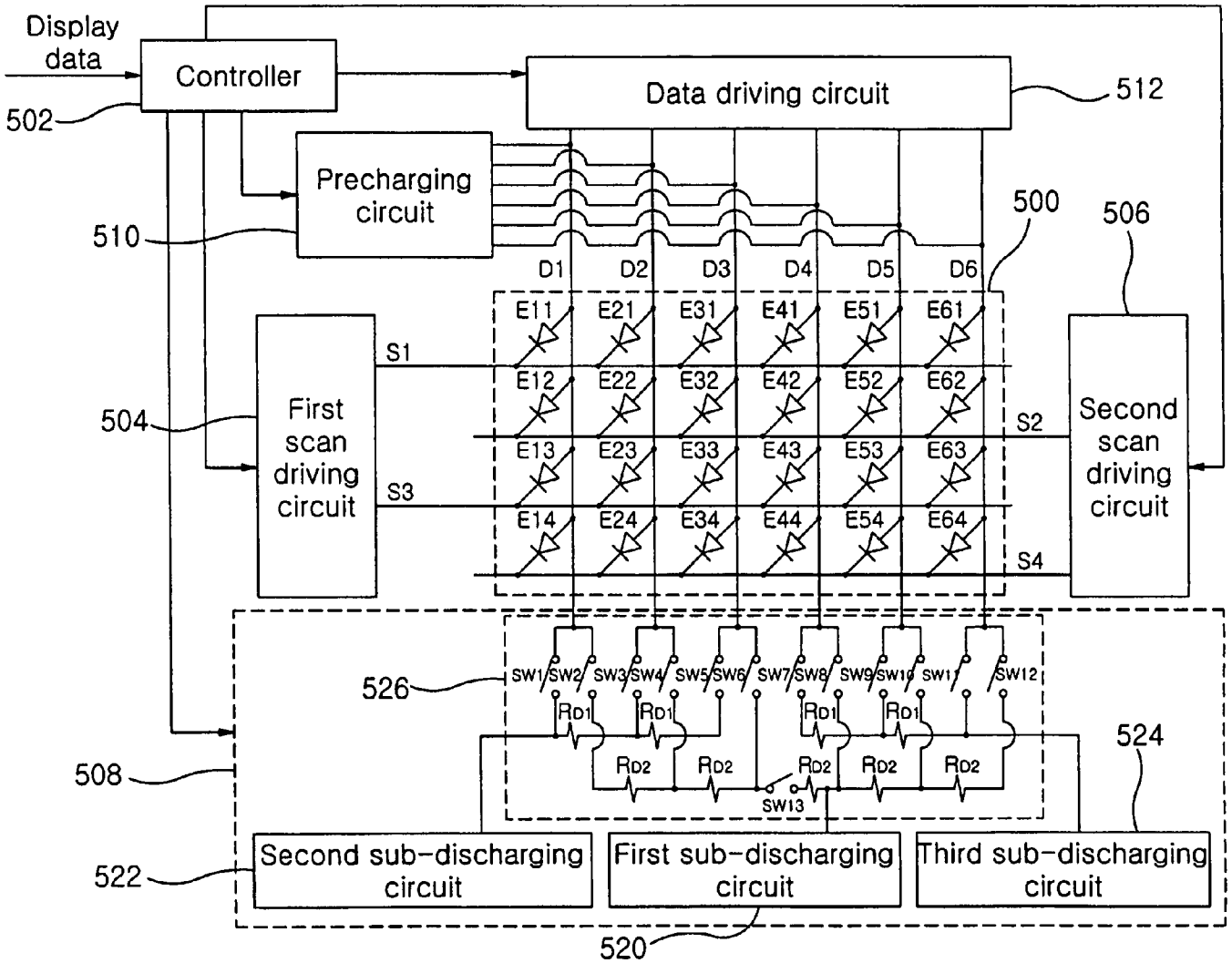
FIG. 5 is a block diagram illustrating a light emitting device according to a second embodiment of the present invention.
Figure 6:
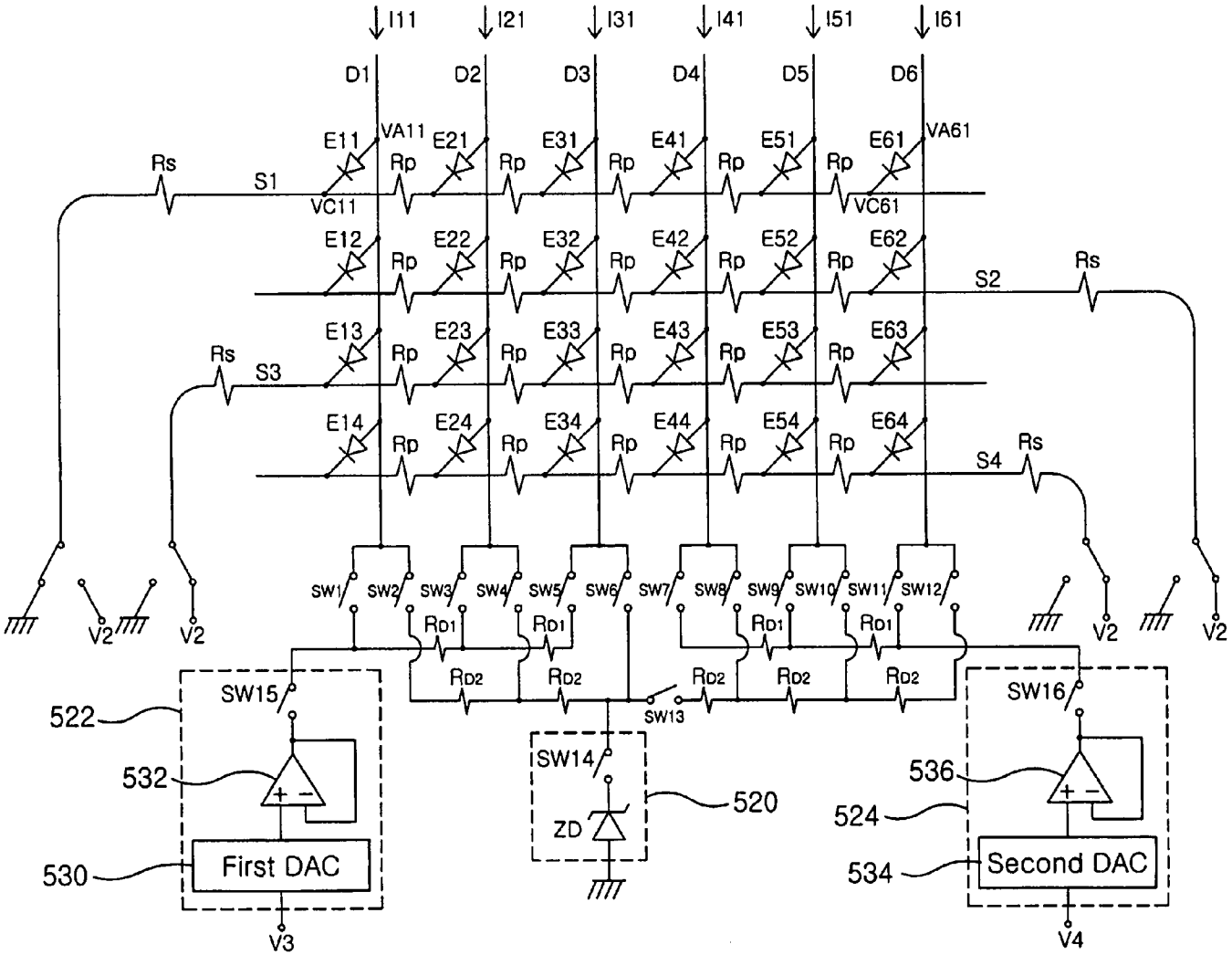
FIG. 6 is view illustrating circuitry of the light emitting device in FIG. 5.

FIG. 5 is a block diagram illustrating a light emitting device according to a second embodiment of the present invention. FIG. 6 is view illustrating circuitry of the light emitting device in FIG. 5.

In FIG. 5, the light emitting device of the present invention includes a panel 500, a controller 502, a first scan driving circuit 504, a second scan driving circuit 506, a discharging circuit 508, a precharging circuit 510 and a data driving circuit 512.

Since elements of the present embodiment except the discharging circuit 508 are the same as in the first embodiment, any further description concerning the same elements will be omitted.

The discharging circuit 508 includes a first sub-discharging circuit 520, a second sub-discharging circuit 522 and a third sub-discharging circuit 524.

The first sub-discharging circuit 520 discharges data lines D1 to D6 up to a certain discharge voltage. For example, the first sub-discharging circuit 520 discharges the data lines D1 to D6 up to a voltage of zener diode ZD using the zener diode ZD as shown in FIG. 5.

The second and third sub-discharging circuits 522 and 524 compensate cathode voltages of pixels E11 to E64. For instance, the second and third sub-discharging circuits 522 and 524 include switches SW15 and SW16, DACs 530 and 534 and OP amplifiers 532 and 536, and their operation is the same as in the first embodiment.

Hereinafter, the light emitting device in the first embodiment and the light emitting device in the second embodiment will be compared.

In the first embodiment, the light emitting device compensates the cathode voltages VC11 to VC64 by using only current outputted from the OP amplifiers 332 and 336, and so power consumption of the light emitting device is high. However, in the second embodiment, the light emitting device compensates the cathode voltages VC11 to VC64 by using the OP amplifiers 532 and 536 after discharging the data lines D1 to D6 up to a certain discharge voltage using the zener diode ZD. Accordingly, the power consumption of the light emitting device in the second embodiment is lower than that of the light emitting device in the first embodiment.

Figure 7:
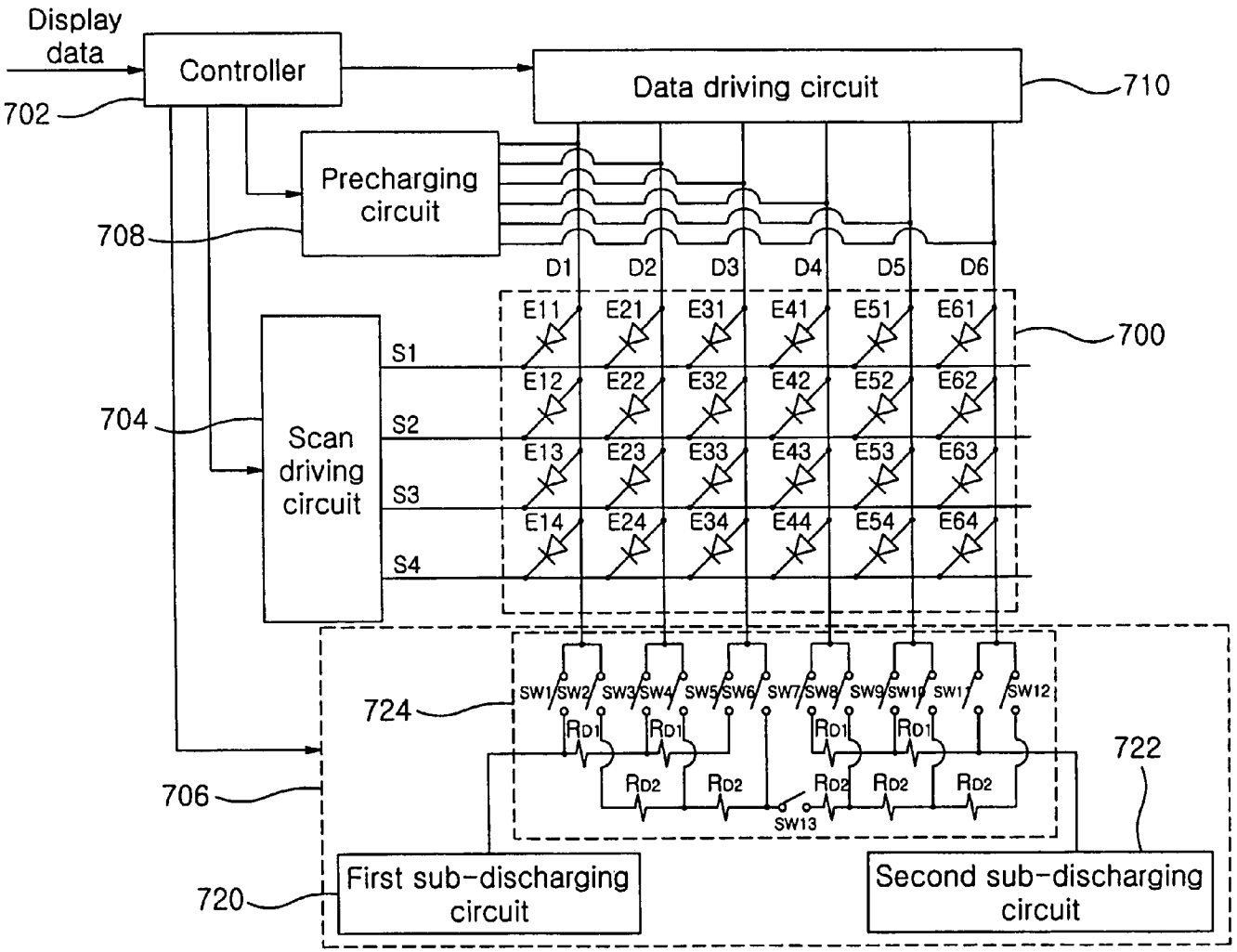
FIG. 7 is a block diagram illustrating a light emitting device according to a third embodiment of the present invention.

FIG. 7 is a block diagram illustrating a light emitting device according to a third embodiment of the present invention.

In FIG. 7, the light emitting device of the present embodiment includes a panel 700, a controller 702, a scan driving circuit 704, a discharging circuit 706, a precharging circuit 708 and a data driving circuit 710.

Since elements of the present embodiment except the scan driving circuit 704 are the same as in the first embodiment, any further description concerning the same elements will be omitted.

In the third embodiment, the scan driving circuit 704 is formed in one direction of the panel 700 as shown in FIG. 7 unlike the scan driving circuits in other embodiments.

From the preferred embodiments for the present invention, it is noted that modifications and variations can be made by a person skilled in the art in light of the above teachings. Therefore, it should be understood that changes may be made for a particular embodiment of the present invention within the scope and the spirit of the present invention outlined by the appended claims.

What is claimed is:

1. A light emitting device comprising:

data lines disposed in a first direction;

a data driving circuit configured to transmit data signals to the data lines;

scan lines disposed in a second direction different from the first direction;

a plurality of pixels formed in cross areas of the data lines and the scan lines; and a discharging circuit configured to discharge respectively a first data line and a second data line of the data lines to a first discharge voltage and a second discharge voltage during a first sub-discharging time of a discharging time, and couple the first data line to the second data line during a second sub-discharging time of the discharging time, wherein the second discharge voltage has different magnitude from the first discharge voltage.

2. The light emitting device of claim 1, wherein the first data line is discharged to a discharge voltage corresponding to cathode voltage of pixel related thereto, and the second data line is discharged to a discharge voltage corresponding to cathode voltage of pixel related to thereto.

3. The light emitting device of claim 1, wherein the discharging circuit includes:

a first sub-discharging circuit configured to provide a first voltage corresponding to the first discharge voltage to the first data line; and a second sub-discharging circuit configured to provide a second voltage corresponding to the second discharge voltage to the second data line.

4. The light emitting device of claim 3, wherein at least one of the sub-discharging circuit includes:

an operational amplifier, wherein an output terminal of the operational amplifier is coupled to data line related to the operational amplifier; and an analog-digital converter (DAC) coupled to an input terminal of the operational amplifier.

5. The light emitting device of claim 1, wherein the discharging circuit discharges some of the data lines to the first discharge voltage and the other data lines to the second discharge voltage during the first sub-discharging time, and couples the data lines during the second sub-discharging time.

6. The light emitting device of claim 5, wherein the discharging circuit includes:

a discharge level circuit configured to couple the some of the data lines, and couple the other data lines during the first sub-discharging time;

a first sub-discharging circuit configured to provide a first voltage corresponding to the first discharge voltage to the some of the data lines; and a second sub-discharging circuit configured to provide a second voltage corresponding to the second discharge voltage to the other data lines, wherein resistors disposed between the data lines have first resistances during the first sub-discharging time, and have second resistances during the second sub-discharging time.

7. The light emitting device of claim 6, wherein the second resistance is higher than the first resistance.

8. The light emitting device of claim 6, wherein some of the second resistances are different from the other second resistances.

9. The light emitting device of claim 6, wherein at least one of the sub-discharging circuit includes:

an operational amplifier, wherein an output terminal of the operational amplifier is coupled to data line related to the operational amplifier; and an analog-digital converter (DAC) coupled to an input terminal of the operational amplifier.

10. The light emitting device of claim 1, wherein the discharging circuit includes:

a first sub-discharging circuit configured to discharge the first data line and the second data line to a predetermined discharge voltage;

a second sub-discharging circuit configured to provide a first voltage corresponding to the first discharge voltage to the first data line; and a third sub-discharging circuit configured to provide a second voltage corresponding to the second discharge voltage to the second data line.

11. The light emitting device of claim 10, wherein the first sub-discharging circuit includes:

a zener diode coupled to the first data line and the second data line, at least one of the second and third sub-discharging circuits includes:

an operational amplifier, wherein an output terminal of the operational amplifier is coupled to data line related to the operational amplifier; and an analog-digital converter (DAC) coupled to an input terminal of the operational amplifier.

12. The light emitting device of claim 1, further comprising:

a scan driving circuit configured to transmit scan signals to the scan lines; and a data driving circuit configured to transmit data signals to the data lines.

13. The light emitting device of claim 1, further comprising:

a first scan driving circuit configured to transmit first scan signals to some of the scan lines; and a second scan driving circuit configured to transmit second scan signals to the other scan lines.

14. An electroluminescent device comprising:

data lines disposed in a first direction;

a data driving circuit configured to transmit data signals to the data lines;

scan lines disposed in a second direction different from the first direction;

a plurality of pixels formed in cross areas of the data lines and the scan lines; and a discharging circuit configured to discharge some of the data lines to a first discharge voltage and the other data lines to a second discharge voltage during a first sub-discharging time of a discharging time, and couple the data lines during a second sub-discharging time of the discharging time, wherein the second discharge voltage is different from the first discharge voltage, and the data lines are discharged to discharge voltages corresponding to cathod voltages of pixels related to the data lines according as the data lines are coupled.

15. The electroluminescent device of claim 14, wherein the discharging circuit includes:

a first sub-discharging circuit configured to discharge the data lines to a predetermined discharge votlage;

a second sub-discharging circuit configured to provide a first voltage corresponding to the first discharge voltage to the some of the data lines; and a third sub-discharging circuit configured to provide a second voltage corresponding to the second discharging voltage to the other data lines.

16. A method of driving a light emitting device having a plurality of pixels formed in cross areas of data lines and scan lines, comprising:

providing scan signals to the scan lines;

providing data currents synchronized with the scan signals to the data lines;

discharging a first data line of the data lines to a first discharge voltage, and second data line of the data lines to a second discharge voltage during a first sub-discharging time of a discharge time; and coupling the first data line to the second data line during a second sub-discharging time of the discharging time, wherein the second discharge voltage is different from the first discharge voltage.

17. The method of claim 16, further comprising:

discharging the first data line and the second data line to a predetermined discharge voltage.

18. The method of claim 16, wherein the step of discharging includes:

providing a first voltage corresponding to the first discharge voltage to the first data line; and providing a second voltage corresponding to the second discharge voltage to the second data line.

19. The method of claim 18, wherein the step of providing the first voltage includes:

outputting a first level voltage in accordance with a first outside voltage; and providing the first voltage to the first data line in accordance with the outputted first level voltage, the step of providing the second voltage includes:

outputting a second level voltage in accordance with a second outside voltage; and providing the second level voltage to the second data line in accordance with the outputted second level voltage.

* * * * *